United States Patent [19]

Stange

[11] 3,971,554

[45] July 27, 1976

[54] SHEET STACKER

[75] Inventor: Klaus K. Stange, Pittsford, N.Y.

[73] Assignee: Xerox Corporation, Stamford, Conn.

[22] Filed: Jan. 9, 1975

[21] Appl. No.: 539,763

[52] U.S. Cl. ..... 271/195; 271/177; 271/212; 271/215; 271/217

[51] Int. Cl.[2] ..... B65H 29/24; B65H 31/10

[58] Field of Search ..... 271/195, 211, 212, 177, 271/178, 215, 217, 219

[56] References Cited

UNITED STATES PATENTS

| | | | |
|---|---|---|---|
| 3,323,645 | 6/1967 | Hori et al. | 271/177 X |
| 3,334,895 | 8/1967 | Daniels et al. | 271/215 X |
| 3,342,481 | 9/1967 | Kaplan | 271/178 |
| 3,396,966 | 8/1968 | Solheim | 271/212 |
| 3,533,620 | 10/1970 | Vasse | 271/212 |
| 3,537,704 | 11/1970 | Bond | 271/177 |

*Primary Examiner*—John J. Love
*Assistant Examiner*—Bruce H. Stoner, Jr.

[57] ABSTRACT

A sheet stacking apparatus wherein individual sheets are inserted between the preceding sheet and an air floatation chamber having angled ports therein for discharge of air in the direction of sheet movement to transport the sheet therebetween, maintain the delivered sheets out of the path of incoming sheets, and hold the delivered sheets in a planar condition.

1 Claim, 2 Drawing Figures

SHEET STACKER

BACKGROUND OF THE INVENTION

With the advent of high speed xerographic reproduction machines, a number of problems have been encountered in attempting to stack the copy sheets produced by the machines. In the presently used devices, sheets entering the stacker are often poorly controlled. The sheet needs to be deformed as it enters the stacker to provide stiffness to prevent it from collapsing as it is pushed into the stack by the trailing edge. Since it is common for sheets discharged from a xerographic reproduction machine to have an electrostatic charge thereon, the trailing edge of the sheet may be electrostatically "floated" and may not clear the path of the succeeding sheet fast enough to prevent jams in the stacker. Further, under severe electrostatic conditions, the lead edge of the sheet being stacked may be attracted to the previous sheet, preventing further movement of the sheet into the stacker without folding the trailing edge of the sheet. To prevent sheets from "floating" in the stacker as they are being delivered, it is common practice to utilize light fingers or strips on top of the stack to hold the sheets down. However, in a xerographic reproduction machine, the copy may be produced by the use of a dry toner material which is thereafter fused to the paper by heat and pressure or the sheet may be developed by a liquid toner. Thus the sheets delivered to the stacker are ordinarily heated or dampened due to the fusing or development process in the machine. In the stacker, the sheet is cooled or dried. In stackers utilizing light finger pressure on the top sheet to prevent floating, the sheets are not controlled relative to flatness with the result that the sheets as they are dried or cooled have a tendency to curl resulting in unacceptable copy.

It is therefore the object of the present invention to provide a stacking mechanism wherein the sheets delivered thereto are acted upon over their entire surface to assure proper positioning thereof in the stack and are held in a planar condition to maintain the entry path clear for subsequent sheets and prevent curling of the sheets as they are cooled or dried.

SUMMARY OF THE INVENTION

An apparatus for receiving and stacking sheets including a sheet tray, feed means adapted to deliver sheets into the sheet tray at an angle relative to the plane of the sheets disposed therein and air plenum means disposed opposite the planar surface of the sheets in the tray, the air plenum means having a plurality of canted ports therein adapted to discharge air against the sheets in the tray in the direction of movement of the sheets into the tray to transport the entering sheets into the proper position therein.

DESCRIPTION OF THE PREFERRED EMBODIMENTS

Figure 1:
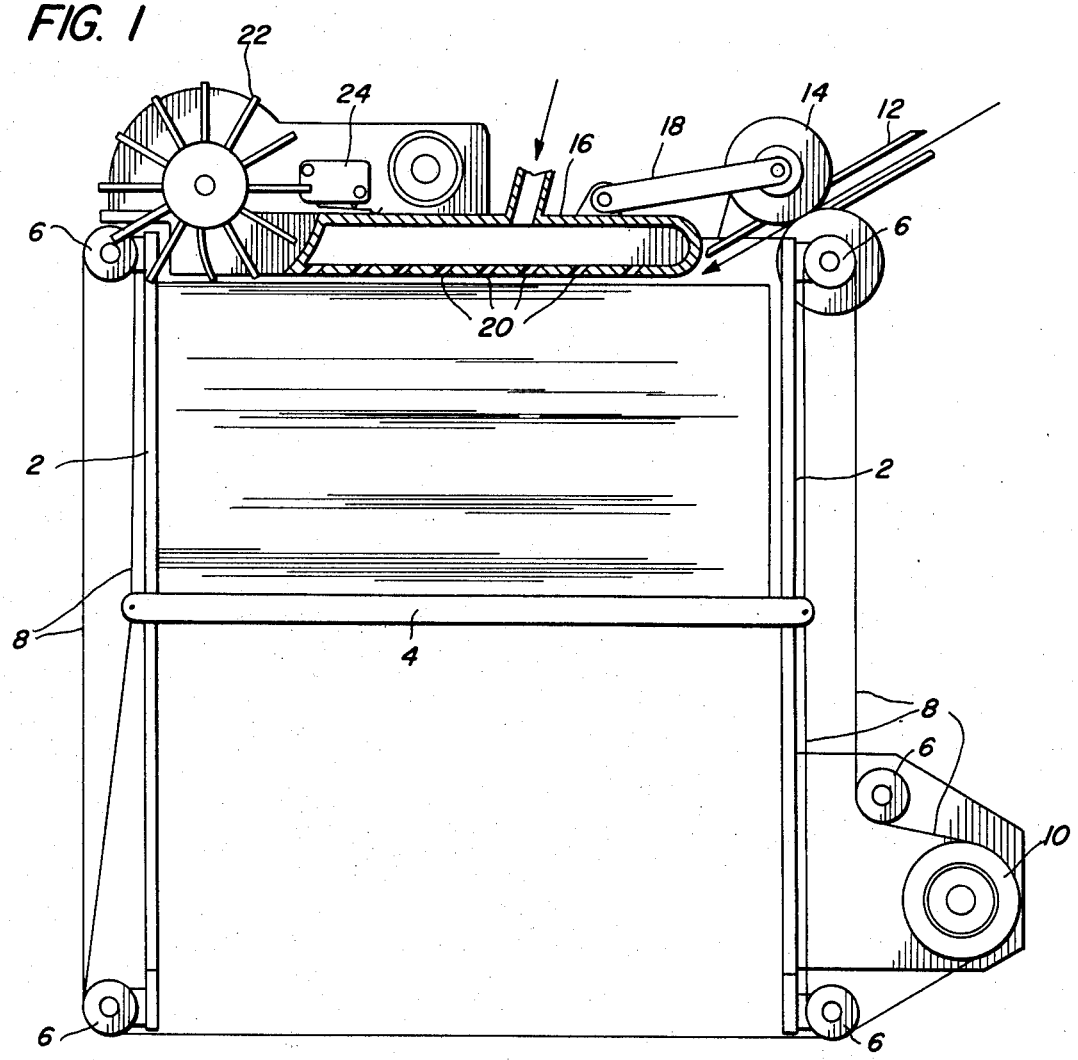
FIG. 1 is a schematic sectional view of a top sheet stacker employing the principles of the present invention; and, FIG. 2 is a schematic sectional view of a bottom sheet stacker employing the principles of the present invention.

Referring to FIG. 1, there is illustrated a sheet stacker including a sheet tray having side walls 2 and a movable base plate 4. The base plate 4 is adapted for movement relaive to the top portion of the tray by means of a plurality of pulleys 6 and cables 8 adapted for movement by a suitable motor 10 affixed to the frame of the stacker mechanism for reasons to be hereinafter explained. Guide means 12 are provided for directing sheets seriatim into a roll pair 14 which feeds sheets onto plate 4 or sheets previously stacked thereon. An air plenum assembly 16 is adapted for floating engagement with the top sheet in the stack by means of pivotal links 18, only one of which is illustrated in FIG. 1. The plenum is provided with a plurality of angled ports 20 adapted for discharge of air supplied thereto from a suitable source (not shown) to force sheets delivered thereunder toward the left as illustrated in FIG. 1 against the left side wall 2. In the event that the air supplied from port 20 is insufficient due to high electrostatic charges on the sheets or extremely heavy sheets, a paddle wheel 22 may be provided for contact with the lead edge of the sheet to positively "paddle" the sheet into proper position against left wall 2.

Considering operation of the sheet stacker illustrated in FIG. 1, sheets supplied thereto are directed by guides 12 and feed roll pair 14 against the preceding sheets stacked in the tray at an angle relative thereto. As the lead edge of the sheet contacts the sheets in the stack and is deflected thereby into the space between the sheets in the stack and the plenum assembly 16, air discharged from the plenum 16 will force the top sheet to the left into contact wih paddle wheel 22 for placing the sheet in the proper position on the stack. The air discharged from ports 20 will also cause plenum assembly 16 to "float" a slight distance above the stack to provide space for receipt of each delivered sheet thereunder. The plenum assembly not only provides transport of the sheet to the left but the force of the air discharged therefrom provides a flattening affect to maintain the sheets in a planar condition and cool or dry the sheets received thereunder. As the sheets are constantly received in the tray, plenum assembly 16 will follow the increasing height of the sheets in the stack until the top surface thereof contacts suitable control means such as microswitch 24 which is adapted to energize motor 10 to lower plate 4 a predetermined distance to allow stacking of subsequent sheets. As sheets are continually received in the stack tray, the plenum assembly 16 will constantly rise and periodically close microswitch 24 to provide a sequential lowering of base plate 4 to compensate for the increasing height of the stack in the tray.

It can be seen that as the sheets enter the stacking tray and are moved to the left under the influence of the air issuing from ports 20 and the paddle wheel 22, the body of the sheet will be maintained in a planar condition due to the force of the paddle wheel thereagainst and the air discharged from ports 20. The beam strength of the paper will cause the trailing edge of the sheet to flatten against the sheets already in the tray and thereby clear the entry throat of the stacker to prevent contact between the leading edge of the subsequent sheet with the trailing edge of the sheet previously delivered to the tray.

It should be understood that in the event a stacker having a lower sheet capacity is desired, the plenum assembly 16 could be solidly mounted on the top portion of the tray and the plate 4 could be spring biased in an upward direction by springs calibrated to compensate for the weight of the sheets to be received thereon, the weight of the sheets and the air pressure built up beneath the stationary plenum assembly 16 causing the plate 4 to be constantly forced lower as increased number of sheets are received thereon.

Figure 2:
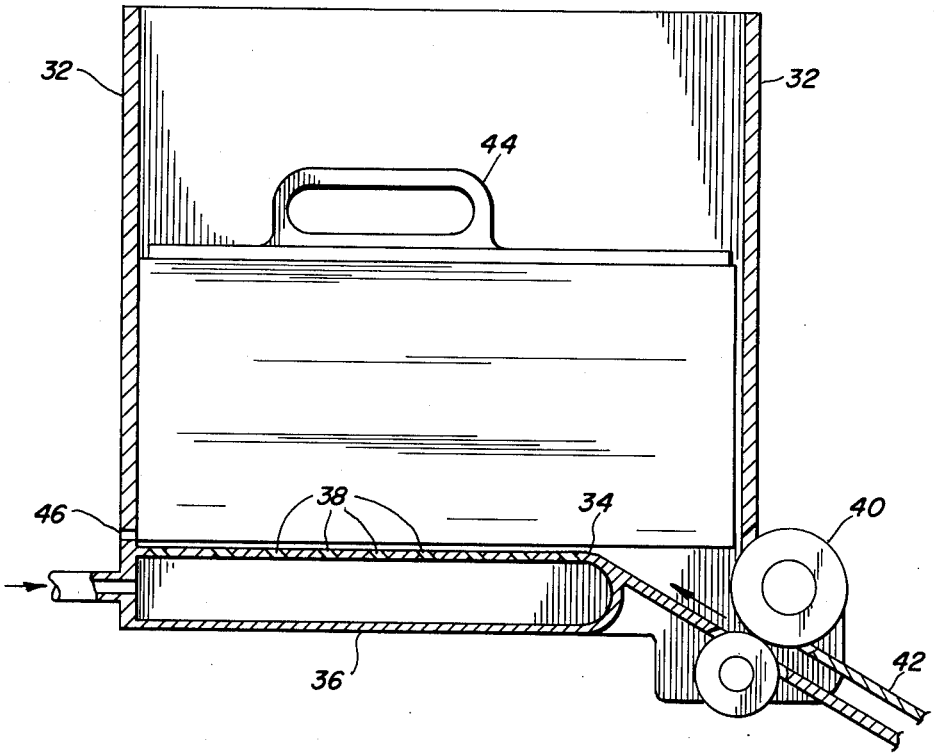

Referring to FIG. 2 there is illustrated a bottom sheet stacker employing the same principles as the stacker illustrated in FIG. 1. The bottom sheet stacker of FIG. 2 includes side walls 32 and a base plate 34 which also serves as a wall of an air plenum 36, base plate 34 having a plurality of canted ports 38 therein adapted for discharge of air in the direction of movement of sheets presented to the bottom of the stack of sheets in the tray by means of a feed roll pair 40. Again, as in FIG. 1, guide members 42 are provided to direct sheets into the stacker at an angle relative to the plane of the sheets therein. A suitable follower plate 44 adapted for placement on top of the sheets in the stack may be utilized to provide sufficient weight on the top of the stack to prevent excessive floating of the sheets therein by air discharged from ports 38 at the start of the stacking operation when the weight of the stack is insufficient therefor. Again as in FIG. 1, sheets presented to the stack by roll pair 40 are directed into the space between the previously stacked sheets and the wall 34 of plenum 36 whereat the air discharged from ports 38 causes the sheets to be moved to the left against wall 32. A suitable opening 46 may be provided in left wall 32 to allow escape of air from beneath the stack and provide a constant stream of air toward the left for movement of sheets thereby. Once the sheet is properly positioned in the stack, the beam strength of the sheet will cause the trailing edge thereof to be lifted up against the remainder of the sheets in the stack to clear the entrance throat for receipt of subsequent sheets. This lifting action caused by the beam strength of the sheets may, in certain circumstances, be aided by contact of the trailing edge of the sheet with the surface of the upper roll of roll pair 40 which would positively move the trailing edge of the last sheet received in the stacker out of the entry throat to prevent contact thereof by the leading edge of the next succeeding sheet. If desired, a paddle wheel assembly as illustrated in FIG. 1 may also be utilized with the embodiment of

FIG. 2.

It can be seen from the foregoing that sheets are presented to the stacker in such a way as to prevent jams at the entry throat thereof and moved to proper position through the action of directed air jets which also act to maintain the sheet in a planar condition as it is dried or cooled to prevent paper curl.

While I have described the preferred embodiments of my invention, it is to be understood that the invention is not limited thereto but may be otherwise embodied within the scope of the following claims.

What is claimed is:

1. A sheet stacking apparatus for receiving and stacking sheets including:

a sheet tray having a planar base plate for stacking sheets thereon and a side wall for abutting sheets thereagainst;

guide means disposed adjacent said tray to direct sheets therein at an angle relative to the plane of said base plate, said base plate being movable in a vertical direction to maintain the top of the stacked sheets adjacent said guide means as the stack height increases with the addition of sheets thereto;

feed means associated with said guide means to feed sheets through said guide means into said tray;

air plenum means having a plurality of air discharge ports therein canted at an angle relative to said base plate for discharge of air against incoming sheets in the direction of movement of the sheets to forward the sheets toward said wall, said air plenum means being disposed above the sheets in the stack for discharge of air in a downward, angled direction;

said air plenum means being mounted for limited movement in a vertical direction, discharge of air therefrom causing said plenum means to float above the sheet stack;

indexing means adapted for vertically indexing said base plate; and, switch means adapted for contact by said plenum means when the height of the sheets in the stack causes said plenum means to float above a predetermined level, said switch means being adapted to energize said indexing means to lower said base plate and the sheets stacked theron to provide space above the stack for receipt of subsequent sheets presented thereto.

* * * * *